United States Patent [19]

Guerrini et al.

[11] 4,010,839

[45] Mar. 8, 1977

[54] CARTRIDGE FOR A RIBBON OF A TYPEWRITER OR LIKE OFFICE MACHINES

[75] Inventors: Giampaolo Guerrini, Ivrea (Turin); Giuseppe Corna, Candia (Turin), both of Italy

[73] Assignee: Ing. C. Olivetti & C., S.p.A., Ivrea (Turin), Italy

[22] Filed: Nov. 25, 1975

[21] Appl. No.: 635,223

[30] Foreign Application Priority Data

Nov. 25, 1974 Italy ..... 70426/74

[52] U.S. Cl. ..... 197/151; 197/173

[51] Int. Cl.[2] ..... B41J 33/04; B41J 35/36

[58] Field of Search ..... 197/151, 168, 173; 226/195; 242/55.17, 192, 75, 199, 75.1–75.4

[56] References Cited

UNITED STATES PATENTS

| | | | |
|---|---|---|---|
| 3,211,273 | 10/1965 | Bishop | 197/151 |
| 3,409,114 | 11/1968 | Okuda | 197/151 |
| 3,442,366 | 5/1969 | Spears | 197/151 |
| 3,528,626 | 9/1970 | Bumb | 242/192 |
| 3,548,994 | 12/1970 | Hudson | 197/151 |
| 3,643,779 | 2/1972 | Anderson et al. | 197/151 |
| 3,731,781 | 5/1973 | Caudill et al. | 197/151 |
| 3,877,561 | 4/1975 | Guerrini et al. | 197/151 |
| 3,887,056 | 6/1975 | Lehmann | 197/168 |
| 3,899,065 | 8/1975 | Brignole | 197/151 |

*Primary Examiner*—Edgar S. Burr
*Assistant Examiner*—Paul T. Sewell

[57] ABSTRACT

A cartridge for a carbon ribbon of an office machine, comprises a container in which are rotatable a feed spool and a take-up for the carbon ribbon. The carbon ribbon passes from the feed spool out of a first aperture and back into the container through a second aperture of the container. The take-up spool is rotatable mounted on a support which is pivoted in the container about a fixed axis. The container has at the bottom an opening arranged in correspondence of a toothed roller also rotatable in the container and adapted to receive a driving shaft of the machine for the rotation of the toothed roller. A spring biases the support of the take-up spool against the teeth of the toothed roller for holding the outermost turn of the carbon ribbon wound on the take-up spool in engagement with the toothed roller, so that for the rotation of the take-up spool by the toothed roller, the ribbon is unwound from the feed spool to the take-up spool.

12 Claims, 4 Drawing Figures

CARTRIDGE FOR A RIBBON OF A TYPEWRITER OR LIKE OFFICE MACHINES

BACKGROUND OF THE INVENTION

The present invention relates to a removable cartridge for a carboncoated ribbon for typewriters, accounting machines, teleprinters and other office machines, comprising a container for a feed spool and a take-up spool for a ribbon and wherein the ribbon is unwound from the feed spool to the take-up spool by means of a toothed roller driven by a driving element of the office machine.

A carbon-coated ribbon cartridge is known wherein the ribbon is unwound from the feed spool to the take-up spool by means of a toothed roller of the machine which engages the outermost turns on the take-up spool. The container is provided with an opening in the form of a circular sector which is adapted to allow accommodation of the toothed roller which, in addition to rotating, must therefore also translate correspondingly to the increase in the turns of the ribbon wound on the take-up spool. Moreover, in order to permit the mounting of cartridges with an already partially unwound ribbon, a supplementary control is provided on the machine which brings the toothed rooler into a position remote from the take-up spool. This complicates the ribbon feed mechanism and makes replacement of the cartridge more difficult.

SUMMARY OF THE INVENTION

The object of the present invention is to provide a removable cartridge which overcomes such problems.

According to the present invention, there is provided a removable cartridge for a carbon-coated ribbon for an office machine, comprising a container housing a feed spool and a take-up spool for a ribbon, the take-up spool being mounted on a movable support and resiliently biased to press the periphery of the ribbon wound on the take-up spool against a toothed roller mounted in the container and engageable by a driving element of the machine on which the cartridge is used for rotating the roller and winding ribbon from the feed spool on to the take-up spool.

BRIEF DESCRIPTION OF THE DRAWING

The invention will be described in more detail, by way of example, in the following description with reference to the accompanying drawing, in which.

DESCRIPTION OF THE PREFERRED EMBODIMENT

Figure 1:
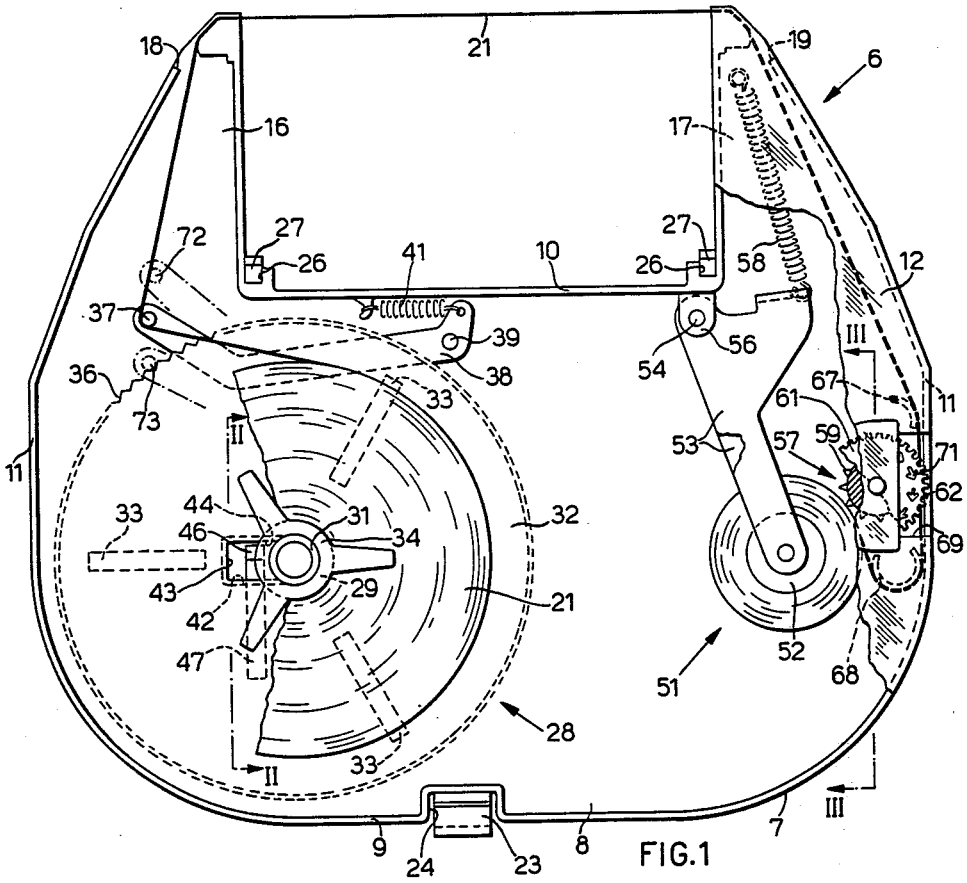
FIG. 1 is a partial plan view of a removable cartridge embodying the invention.

Referring to FIG. 1, a removable carbon-coated ribbon cartridge 6 comprises a container 7 having a substantially parallelepipedal form with the front corners radiused. The container 7 has a base 8, a front wall 9, a rear wall 10, two side walls 11 which connect the walls 9 and 10, and a cover 12 which closes the container 7 at the top.

Figure 3:
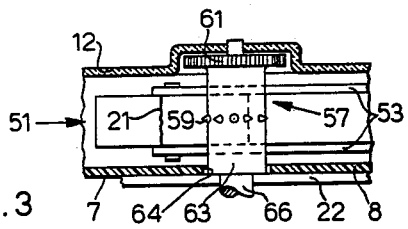
FIG. 3 is another partial section on the line III—III of FIG. 1.

The cartridge 6 also has two hollow arms 16 and 17 projecting from the rear wall 10 and each having an opening 18, 19, adapted to permit the passage of a carbon-coated ribbon 21. In use, the cartridge 6 is fixed removably to a support 22 (FIG. 3) of an office machine by means of a leaf spring 23 (FIG. 1) which is engaged in a slot 24 in the front wall 9 and holds two slots 26 adjacent the arms 16 and 17 arrested agsinst corresponding fixed stops 27 of the machine.

Figure 2:
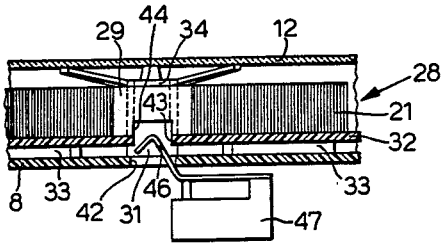
FIG. 2 is a partial section on the line II—II of FIG. 1.

In the container 7 there is housed a feed spool 28, on which is wound the carbon-coated ribbon 21. The feed spool 28 comprises a core or hub 29, which can rotate about a sleeve 31 projecting from the base 8, and a flange 32 fixed to the core 29 at the bottom thereof. A three-armed spider spring 34 (FIG. 2) between the cover 12 and the core 29 and centred by the sleeve 31 keeps the feed spool flange 32 bearing aginst three ribs 33 projecting from the base 8.

The flange 32 (FIG. 1) is provided at its outer edge with a series of peripheral notches 36 adapted to cooperate with a detent pin 37 of a ribbon tensioning element 38 to prevent chance rotation of the feed spool 28 and therefore the unwinding of the carbon-coated ribbon 21. The ribbon tensioning element 38 is constituted by a lever having the detent pin 37 at one end and pivoted at the other end on a pin 39 projecting from the base 8. The detent pin 37 moreover guides the ribbon 21 between the feed spool 28 and the opening 18. A tension spring 41 tends to cause the ribbon tensioning element 38 to turn anti-clockwise, bringing the detent pin 37 up to the notches 36.

The base 8 of the container 7 is provided with an opening 42 (FIG. 2) formed to correspond with a window 43 in the flange 32 and with a window 44 in the core 29. This allows the passage of an end-of-ribbon sensor 46 of a signalling device 47 of the machine. The signalling device 47 is adapted to determine the presence or absence of the carbon-coated ribbon 21 on the feed spool 28 and is constituted by a microswitch which signals such presence or absence to a control logic unit (not shown in the drawings). The end-of-ribbon sensor 46 is constituted by a tongue or blade fulcrumed on the microswitch 47 at its other end and having one end bent into a V-shape to extend through the opening 42 and into the windows 43 and 44 to come into contact with the lower edge of the ribbon 21 which is possibly wound around the core 29.

In the container 7 (FIG. 1), there is also housed a take-up spool 51, on which the carbon-coated ribbon 21 is wound after it has been used at the printing point between the two arms 16 and 17. The take-up spool 51 is constituted by a core 52 which is mounted rotatably on a support 53 pivoted on a pin 54 of a lug 56 projecting inwardly from the rear wall 10.

The support 53 is constituted by a bail and is movable along a path substantially perpendicular to the axis of a feed roller 57 and supported rotatably by the container 7. A tension spring 58 resiliently urges the bail 53 anti-clockwise to be arrested with the ribbon 21 on the take-up spool 51 against a toothed wheel 59 of the feed roller 57.

The feed roller 57 includes at the top a disc 61 having a milled periphery 62 for manual actuation of the feed roller 57. Through the medium of a sleeve 63 (FIG. 3) housed in an opening 64 in the base 8 of the container 7, the feed roller 57 is moreover engageable at the bottom by a driving shaft 66 of the machine.

Finally, from the base 8 of the container 7 there projects guide means comprising a first element 67 (FIG. 1) and a second element 68 which are adapted to convey the carbon-coated ribbon 21 from the opening 19 into the proximity of the feed roller 57 and then towards the take-up spool 51. The guide means 67 and 68 have the form of cylindrical sectors and a height substantially equal to the height of the carbon-coated ribbon 21.

Therefore, the carbon-coated ribbon 21, unwinding from the feed spool 28, bears against the detent pin 37, emerges from the opening 18, re-enters by the opening 19, bears against the elements 67 and 68, outside the path of the toothed wheel 59, and is wound on the take-up spool 51. Owing to the action of the spring 58, the toothed wheel 59 engages the outermost turns of the ribbon 21 wound on the take-up spool 51 with its teeth in the proximity of the median portion of the carbon-coated ribbon 21. The rotation of the feed roller 57 through the agency of the driving shaft 66 (FIG. 3) causes the take-up spool 51 to rotate and causes the carbon-coated ribbon 21 to be wound in equal incremental steps on the core 52 (FIG. 1) in a manner known per se. The presence of a single row of teeth on the toothed wheel 59 ensures that the carbon-coated ribbon 21 is pulled uniformly and parallel to the axis of the take-up spool 51.

The cover 12 of the container 7 is provided with a window 69, formed to correspond with the disc 61 of the feed roller 57, for permitting manual feed or advance of the carbon-coated ribbon 21, which is effected in the direction of the arrows 71.

During the feed of the carbon-coated ribbon 21, the ribbon tensioning element 38 oscillates owing to the action of the spring 41 between the position shown by a continuous line and another position indicated by the reference 72 and shown by a chain-dotted line, always keeping the carbon-coated ribbon 21 under tension. With the driving shaft 66 (FIG. 3) stopped, the spring 41 (FIG. 1) causes the ribbon tensioning element 38 to turn anticlockwise and pass from the position shown by a continuous line to a position indicated by the reference 73 and shown by a chain-dotted line, until the detent pin 37 is brought into contact with the notches 36 of the flange 32. In this way, the flange 32 is arrested and the carbon-coated ribbon 21, while remaining under tension, can no longer unwind, even in the presence of vibration or shocks.

Figure 4:
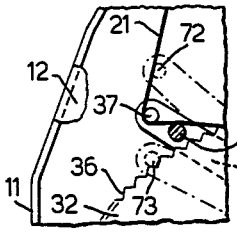
FIG. 4 is a partial plan view of a variant of FIG. 1.

Among possible modifications, the cartridge 6 may be provided with a pin 76 (FIG. 4) integral with the cover 12 and projecting inside the cartridge 6 towards the flange 32. The carbon-coated ribbon 21 is wound first around the pin 76 and thereafter around the detent pin 37 of the ribbon tensioning element 38 in a manner such as to keep the load acting on the ribbon 21 always constant both when the number of turns wound on the feed spool 28 (FIG. 1) is at the maximum and when it is at the minimum.

We claim:

1. A carbon coated ribbon cartridge removably mountable in a typewriter or other printing office machine wherein the typewriter includes a driving shaft for driving said ribbon, the cartridge comprising:

a container having a bottom portion and a top portion;

a feed spool on which said carbon ribbon is normally wound, said feed spool being rotatably supported in said container between said bottom and said top portion;

a take-up spool for receiving said carbon ribbon;

means defining a first and a second aperture in said container adjacent said feed spool and said take-up spool, respectively, said carbon ribbon extending through said first aperture to the exterior of said container and returning to the interior thereof through said second aperture;

a toothed roller rotatably mounted in said container between said bottom and said top portion adjacent said take-up spool, said toothed roller having a connecting portion engageable with the driving shaft of the machine;

means defining an opening in the bottom portion of said container, alignment with said toothed roller so as to enable said driving shaft to engage the connecting portion of said toothed roller for the rotation thereof, during use;

a support member movably mounted in said container between said bottom and top portion and on which said take-up spool is rotatably mounted; and resilient means acting on said support member for holding an outermost turn of said carbon coated ribbon wound on said take-up spool in engagement with said toothed roller for the winding of said carbon coated ribbon on said take-up spool in response to the rotation of said driving shaft.

2. A cartridge according to claim 1, wherein said container includes a further aperture and said toothed roller includes a manually actuatable portion accessible through said further opening for the manual rotation of said toothed roller.

3. A cartridge according to claim 2, wherein said further aperture includes a window in said top portion and the manually actuatable portion of said toothed roller includes a disc with a milled periphery projecting from said window.

4. A cartridge according to claim 1, wherein said support member comprises a bail embracing said take-up spool and pivoted about an axis substantially parallel to the axis of said toothed roller.

5. A cartridge according to claim 1, wherein said feed spool is located at one said of said container, said toothed roller is located in another side of said container opposed to said one side and said support member is movable between said one and said other side in response to the quantity of ribbon wound on said take-up spool.

6. A cartridge according to claim 1, wherein said container further comprises a first guide element for conveying said carbon ribbon from said second aperture toward said toothed roller outside thereof and a second guide element for conveying said carbon ribbon from said first guide element to said take-up spool along a predetermined path tangent to said roller in the zone thereof in which engages the outermost turn of ribbon wound on said take-up spool.

7. A carbon coated ribbon cartridge removably mountable in a printing office machine wherein the machine includes a feed device for feeding said ribbon, the cartridge comprising: a container; a feed spool rotatably mounted in said container and around which a carbon coated ribbon is normally wound for feeding by said feed device during use; a take-up spool rotatably mounted in said container for receiving said carbon ribbon; means connecting the feed device of the machine with said take-up spool for taking-up said ribbon around said take-up spool during use of said feed device; and means controlled by the tension of said carbon ribbon to prevent undesirable rotation of said feed spool during disuse of said feed device, said means comprising a flange on said feed spool having a series of peripheral notches thereon; a ribbon tensioning member movably mounted on said container for guiding the ribbon unwinding from the feed spool; a detent pin supported by said ribbon tensioning member for engaging the peripheral notches of said flange; and a spring member biasing said ribbon tensioning member toward said flange for engaging said detent pin in one of said notches during disuse of said feed device thereby blocking said feed spool, said take-up spool releasing said detent pin from said one notch during use of said feed device against the action of said spring upon said ribbon tensioning member.

8. A cartridge according to claim 7, wherein said container comprises first and second walls; means supporting said feed spool between said first and said second walls; said flange being adjacent said first wall; and a pin projecting inside said container from said second wall toward said first wall, wherein said ribbon tensioning member comprises a lever and said detent pin is fixed on said lever; the carbon ribbon unwinding from said feed spool bearing against said projecting pin and thereafter around said detent pin of said lever for keeping the tension acting on said carbon ribbon substantially constant both when the number of turns wound on said feed spool is at a maximum and when it is at a minimum.

9. A cartridge according to claim 7, wherein the feed device of the machine comprises a feed shaft and wherein said container further comprises a first aperture and a second aperture adjacent said feed spool and said take-up spool, respectively; said carbon ribbon extending through said first aperture to the exterior of said container and returning to the interior of said container through said second aperture; wherein the means connecting the take-up spool with said feed shaft comprise a toothed roller rotatably mounted in said container and cooperative with an outermost turn of ribbon wound around said take-up spool, for winding said carbon ribbon from said feed spool on to said take-up spool; further comprising a first guide and friction element for frictionally conveying the carbon ribbon from said second aperture toward said toothed roller and a second guide and friction element for frictionally conveying the carbon ribbon from said first guide and friction element onto said take-up spool.

10. A cartridge for a carbon ribbon removably mountable on an office machine of the type which utilizes a carbon coated ribbon cartridge wherein the ribbon is windable from a feed spool to a take-up spool, a feed device for feeding said take-up spool, means for removably fixing the cartridge on the machine, and an end of ribbon sensor for signalling the presence of the ribbon on the feed spool; said cartridge comprising a container having a cover and a base between which said feed spool and said take-up spool are rotatably mounted in said container; a first and a second aperture adjacent said feed spool and said take-up spool, said carbon ribbon extending through said first aperture to the exterior of said container and returning to the interior of said container through said second aperture; means connecting said take-up spool with said feed device during use, said feed spool having a flange adjacent said base and a core connected with said flange and around which an innermost turn of said ribbon is wound, said flange having a window and said core having a notch substantially aligned with the window of the flange; and means defining an opening at the base of said container arranged in alignment with the window of said flange and the notch of said core, said fixing means causing said opening to be disposed in alignment with said sensor for allowing said end of ribbon sensor of said office machine to pass through said opening, said window and said notch to sense the presence or absence of the innermost turn of ribbon wound on said feed spool.

11. A cartridge according to claim 10, wherein the feed device of the office machine includes a driving shaft, wherein said container comprises a toothed roller rotatably mounted in said container between said base and said cover, and wherein said means connecting said take-up spool with said feed device comprise means defining an opening on the base of said container arranged in alignment with said toothed roller so as to receive said driving shaft, said toothed roller being engageable by said driving means; a support member movably mounted in said container and on which said take-up spool is rotatable mounted; means movably supporting said support member for a movement substantially parallel to the axis of said toothed roller; and resilient spring biasing said support member for holding an outermost turn of said carbon ribbon wound on said take-up spool in engagement with toothed roller.

12. A cartridge according to claim 10, wherein the flange of said feed spool includes a series of peripheral notches; further comprising a spring biased ribon tensioning member mounted on said container and controlled by the tension of said carbon ribbon for preventing unwinding of the ribbon from the feed spool when the feed device is not operative to tension the ribbon, said ribbon member having a tensioning detent pin for engaging said peripheral notches of said flange to block the rotation of said feed spool.

* * * * *